US007000445B2

(12) United States Patent
Hepner et al.

(10) Patent No.: US 7,000,445 B2
(45) Date of Patent: Feb. 21, 2006

(54) SYSTEM FOR FORMING AN ELONGATED CONTAINER

(75) Inventors: Mark E. Hepner, Massillon, OH (US); Barry Lippert, Canton, OH (US)

(73) Assignee: Stolle Machinery Company, LLC, Centennial, CO (US)

( * ) Notice: Subject to any disclaimer, the term of this patent is extended or adjusted under 35 U.S.C. 154(b) by 127 days.

(21) Appl. No.: 10/737,587

(22) Filed: Dec. 15, 2003

(65) Prior Publication Data

US 2005/0126247 A1 Jun. 16, 2005

(51) Int. Cl.
*B21D 22/00* (2006.01)

(52) U.S. Cl. ..... 72/349; 72/342.3; 72/347; 72/364; 72/379.4; 72/715; 413/69

(58) Field of Classification Search ..... 72/38, 72/342.3, 347, 348, 349, 364, 379.4, 453.02, 72/453.07, 715; 413/69
See application file for complete search history.

(56) References Cited

U.S. PATENT DOCUMENTS 3,678,725 A * 7/1972 Langewis ..... 72/344
3,733,881 A 5/1973 Grigorenko ..... 72/349
4,166,372 A * 9/1979 Knight ..... 72/348
4,416,140 A * 11/1983 Bulso et al. ..... 72/345
4,425,778 A * 1/1984 Franek et al. ..... 72/347
4,502,313 A * 3/1985 Phalin et al. ..... 72/342.3
4,732,031 A 3/1988 Bulso, Jr. et al.
5,024,077 A 6/1991 Bulso, Jr. et al. ..... 72/336
5,626,048 A 5/1997 McClung ..... 72/336
6,490,904 B1 * 12/2002 Zauhar ..... 72/348
6,598,450 B1 * 7/2003 Blue ..... 72/342.3

* cited by examiner

*Primary Examiner*—Ed Tolan
(74) *Attorney, Agent, or Firm*—David P. Maivald; Eckert Seamans Cherin & Mellott, LLC

(57) ABSTRACT

A system for forming a cup used in forming an elongated container including a draw-redraw station including a movable platen carrying a punch shell; a punch core riser, a punch core mounted on the punch core riser; and a first, fluidly actuated pressure sleeve; and a fixed base carrying a pressure pad; a die core ring; and a die core; the punch shell being movable toward the die core ring to wipe the blank over the die core ring to form an inverted cup; the punch core being movable toward the die core to reverse draw the inverted cup and form the cup; and the die core ring engaging the material against the punch core during the reverse draw to control metal thickness; and a cooling assembly including a chiller, a coolant passage formed in the punch core and fluidly connected to the chiller.

16 Claims, 8 Drawing Sheets

SYSTEM FOR FORMING AN ELONGATED CONTAINER

RELATED PATENT APPLICATIONS

None.

FIELD OF THE INVENTION

In general, the present invention relates to a method and apparatus for forming an elongated metal container. More particularly, the present invention relates to the use of a draw-redraw press for forming an elongated container. Most particularly, the present invention relates to such a press having a cooling and venting system for maintaining the integrity of the container during the draw-redraw process.

BACKGROUND OF THE INVENTION

Metal containers are used for a large variety of consumer products including food containers, beverage containers, and aerosol product containers. For years, these containers have had a familiar shape and appearance. In large part, food and beverage containers are formed by a successive drawing process. In contrast, due to their length, aerosol cans are typically formed by welding or otherwise seaming two edges of a piece of sheet material to form a cylindrical can body that is attached to end caps. Or, in some cases, an aluminum slug is used to perform a deep drawing process to form an aerosol can. While sheet drawing presents a more economical method of forming, existing presses are not suitable for forming aerosol cans. The distances that the punch would have to travel in either drawing or ironing a container from a sheet of material make them impractical for such an application. Further, the use of such drawn blanks places extreme demand on the control of the material thickness, as cracking and tearing of the material is very likely to occur.

With that backdrop, container manufactures have looked away from using a sheet drawing process to form elongated containers, such as aerosol cans. They have relied on tried and true methods that provide cost certainty and do not require any investment in tooling.

Increasingly, marketing people are looking for ways to differentiate their products from others. A recent trend has developed to provide containers of different shapes and dimensions to create product identity. So far, in the beverage industry, while new various diameter containers are produced, these containers are still limited to the draw heights used for traditional containers. This trend is spreading beyond beverage containers as, consumers demand unique elongated containers that provide the volume necessary for aerosol products. Consequently, to meet the demands of the industry, a system for forming an elongated container from a sheet of material is needed.

SUMMARY OF THE INVENTION

It is an object of the present invention to form an elongated container from metal sheet stock.

In light of this object, the present invention provides a system for forming an elongated container including a draw-redraw station including a movable platen carrying a punch shell; a punch core; and a first, fluidly actuated pressure sleeve; and a fixed base carrying a pressure pad; a die core ring; and a die core; the punch shell being movable toward the die core ring to wipe the blank over the die core ring to form an inverted cup; the punch core being movable toward the die core to reverse draw the inverted cup and form the cup; and the die core ring engaging the material against the punch core during the reverse draw to control metal thickness and a cooling assembly including a chiller and coolant passage formed in the punch core and fluidly connected to the chiller.

The present invention further provides a method of forming a cup for forming an elongated container including blanking a sheet of material to form a blank; wiping the peripheral edge of the blank about a die core ring to form an inverted cup; reverse drawing the inverted cup by advancing a punch into a die core; and removing heat from the punch by circulating a coolant through passages formed in the punch.

It is also an object of the present invention to provide a system for forming a cup used in forming an elongated container including a draw-redraw station including a movable platen carrying; a punch shell; a punch core riser, a punch core mounted on the punch core riser; a first, fluidly actuated pressure sleeve; a fixed base carrying a pressure pad; a die core ring; a die core; the punch shell being movable toward the die core ring to wipe the blank over the die core ring to form an inverted cup; the punch core being movable toward the die core to reverse draw the inverted cup; the die core ring engaging the material against the punch core during the reverse draw to control metal thickness; a cooling assembly including a chiller, a coolant passage formed in the punch core riser and fluidly connected to the chiller; wherein the punch core includes an inner core fastened to the punch core riser, the inner core defining a coolant passage extending in a crosswise fashion throughout the inner core; the passage on the inner core being in fluid communication with the coolant passage formed in the punch core riser, and a sleeve mounted on the punch core riser and surrounding the inner core.

BRIEF DESCRIPTION OF THE PREFERRED EMBODIMENTS

Figure 1:
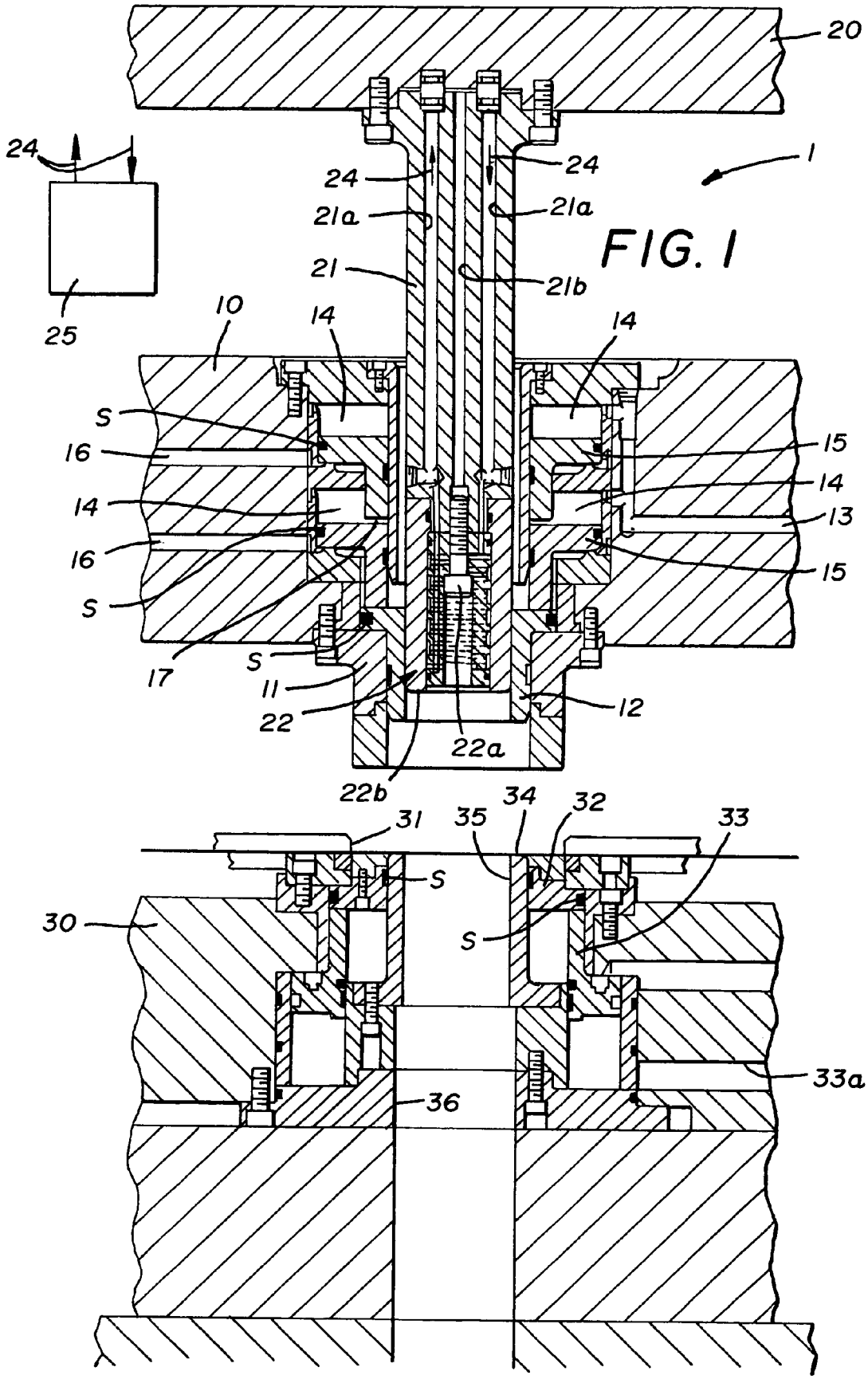
FIG. 1 is a sectional side elevational view of a press according to the concepts of the present invention depicted in an open condition.

A press for forming an elongated container is illustrated in the drawings and is generally referred to by the numeral 1. Material M may be fed into the press 1 as a sheet from either a coil or a stack of individual sheets, as desired.

The press 1 includes a slide holder 10 that carries a punch shell 11 secured to the slide holder 10 for movement therewith. Radially inward of the punch shell 11 is a first pressure sleeve 12, which is under fluid pressure, either air or hydraulic, and is reciprocal in a chamber formed by the slide 10 and a punch core riser 21. Fluid pressure is provided to pressure sleeve 12 by passages 13 that pressurize chambers 14 formed behind pistons 15, which act on pressure sleeve 12. During press operation, the pressure sleeve 12 compresses pistons 15. To maintain the proper pressure, vents 16 are provided to selectively release fluid from chambers 14. According to another aspect of the present invention, the pistons 15 may be staged by providing a gap at 17 between the pistons 15. The gap 17 is relatively small and may be about 0.001 to 0.01 inches. This range is provided only as an example and is not limiting. The gap 17 creates a delay between the impact on each piston 15, such that, the initial impact of the punch assembly is partially absorbed by the first piston before the second piston is contacted. This reduces the likelihood that initial contact of the punch with the material will create a weakened area in the cup C.

The inner slide 20 of the press 1 carries the punch core riser 21 and a punch core 22 adjustably secured thereto, as by a screw 22*a*. The punch core 22 has a nose 22*b*, which may be contoured to profile the bottom surface of a cup C formed in the press 1. In the example shown, nose 22*b* does not have a contour, such that, the finished cup C exiting press 1 is more easily elongated. To achieve the draw ratios described below, it is preferable not to initially profile the material M.

The punch core riser 21 defines at least one coolant passage 21*a* for controlling the temperature of the punch core riser 21. In the example shown, a pair of parallel coolant passages run downward through the punch core riser 21 delivering a coolant 24, which may be water, to the punch core riser 21. The coolant passages 21*a* are supplied by a coolant supply that passes through a chiller 25 shown schematically in FIG. 1. The chiller 25 may be a heat exchanger or similar device. Coolant is circulated through passages 21*a* and returned through the chiller 25 to cool the coolant before it is directed back to the press 1. In this way, the chiller 25 substantially maintains the coolant temperature to maintain a selected temperature in the punch core riser 21. While the temperature maintained at the chiller 25 will change depending on each application, the temperature may be at least ambient temperature. In one example, a temperature of 120° F. was found suitable in producing cups within the desired tolerances for an aerosol can application.

Figure 4A:
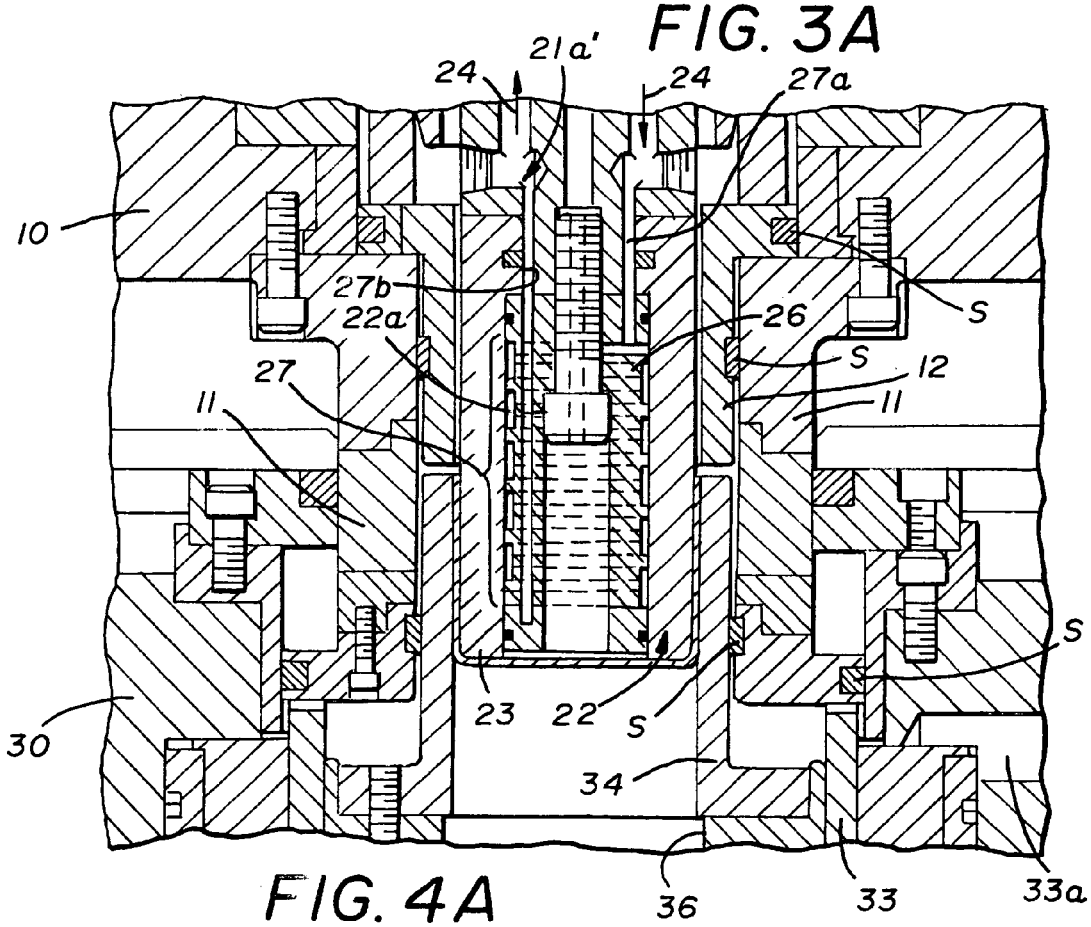
FIG. 4*a* is a sectional side elevational view similar to FIG. 4 enlarged to show details of the finished cup formation.
Figure 8:
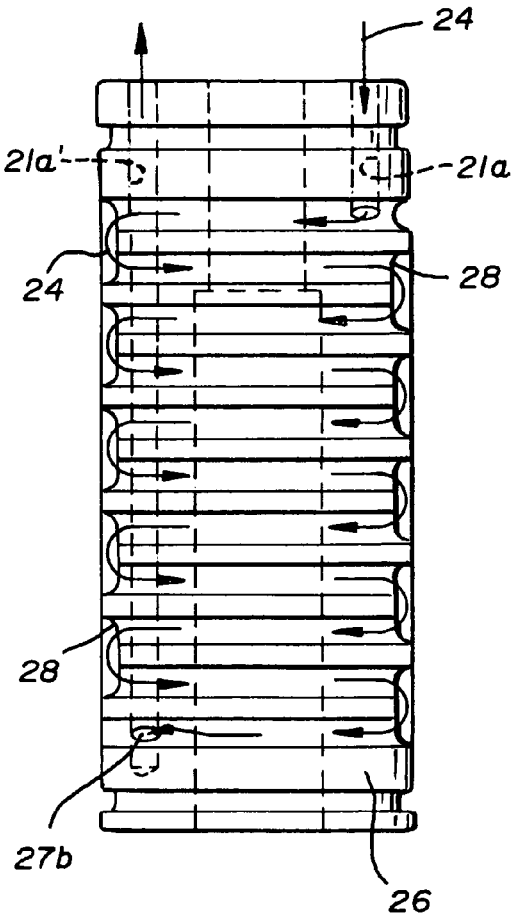
FIG. 8 is a side elevational view of an inner core of a punch assembly according to the concepts of the present invention.
Figure 9:
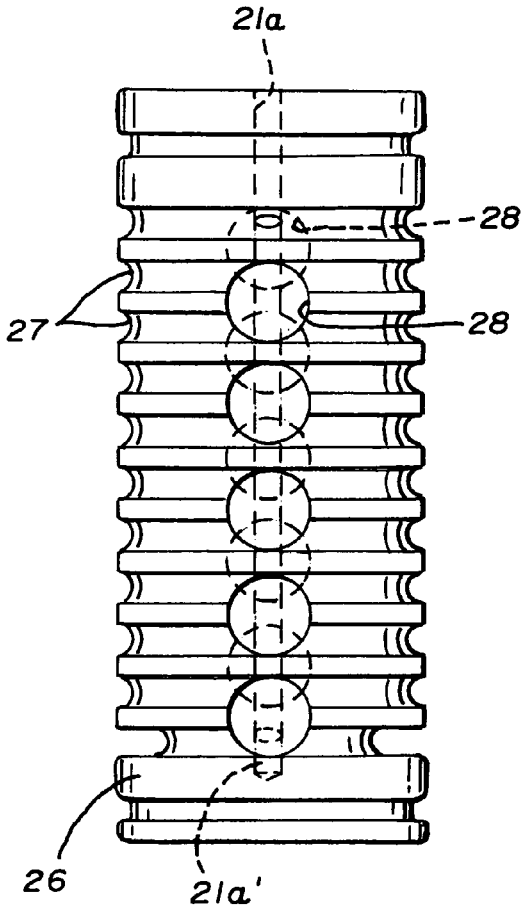
FIG. 9 is a side elevational view similar to FIG. 8 rotated 90° to show additional details of the inner core.

With reference to FIGS. 4A, 8, and 9 it may be seen that coolant passages 21*a* may extend downward into punch core 22 to similarly maintain the temperature of punch core 22. In the depicted example, a series of annular passages 27 permeate the punch core 22 to distribute coolant 24 throughout the punch core 22. As best shown in FIG. 4A, to maintain a suitable flow rate, the inlet 27*a* to the punch core may be smaller than passageway 21*a*. To distribute coolant 24 throughout the punch core 22, as best shown in FIGS. 8 and 9, passages 27 may run throughout the core. In the example shown, the punch core 22 is essentially constructed of two pieces, an inner core 26 defines a series of annular passages 27 interconnected to each other in successive fashion at recesses 28 on its outer surface and punch core sleeve 23 fits over the inner core 26 to enclose the passages 27 and recesses 28. To distribute coolant 24 throughout the punch core 22, the coolant 24 enters the annular passages 27 and flows around the periphery of the inner core to a recess 28, where it is directed downward to the next passage 27. In the example shown, in FIGS. 8 and 9 the annular passages 27 extend between diametrically opposed recesses 28. Recesses 28 are, therefore, axially offset downward the height of approximately on passage 27 relative to their diametrically opposed counterpart to successively transport the coolant 24 downward through passages 27. After circulating through the punch core 22, the coolant 24 may return to the chiller 25 through an exit 27*b* that interconnects with a return passage.

By controlling the temperature within the punch assembly, thermal expansion of the components may be controlled to ensure more consistent forming throughout the run-cycle of the press 1. The circulation of coolant through passages 21*a* and 27 reduce the likelihood of the cup C being formed with wall thicknesses that are below tolerance and prevent tearing of the cup C.

In addition to the coolant passages 21*a*, 27, the punch core riser 21 may define an air supply passage 21*b* that delivers a charge of air after cup formation to assist in removing the formed cup C from the punch core 22.

A press base 30 lies below the outer slide holder 10 and includes a cut edge 31 for blanking the material M. In forming an elongated container, it is expected that uneven draw height about the circumference of the container as a result the grain of the sheet of material M may be exacerbated by the larger draw. To accommodate this, the material may be blanked in a non-circular fashion. Concentrically disposed radially inward of the cut edge 31 is a pressure pad 32 supported by a fluidly actuated piston 33. Still further radially inboard of pressure pad 32 is a fixed die core ring 34 mounted on the base 30. Die core ring 34 defines a bore 35 that receives the punch core 22 during the redraw process. Base 30 further defines enlarged vents 33*a* to dissipate heat created during forming. For the example shown, it has been found that vents 33*a* having a diameter of at least about 0.875 inches are suitable for venting heat sufficient to maintain a suitable material thickness during formation. It will be appreciated that individual design considerations for a given application, such as desired thickness and cup size, may change this valve, and thus it is not to be considered limiting.

The improved heat dissipation by the vents 33*a* and the cooling system, described above, increases the life of the press 1 and reduces downtime. In particular, in forming an elongated cup C in the present invention, high temperatures, relative to ordinary can pressures, were generated. The heat within the press 1 was sufficient to degrade or, at times, melt seals S. As will be appreciated these seals S are expensive but, more importantly, require considerable downtime to replace. This downtime can be quite costly when considering the number of cans produced each minute in press 1. The base 30 defines an exit bore 36 through which the finished cup C leaves the press 1. As shown, the exit bore 36 may be formed beneath the bore 35 such that the finished cup C drops from the die core ring 34 upon being released. Suitable conveying means such as belts or air jets may be used to direct the finished cup C downstream for further machining.

Figure 5:
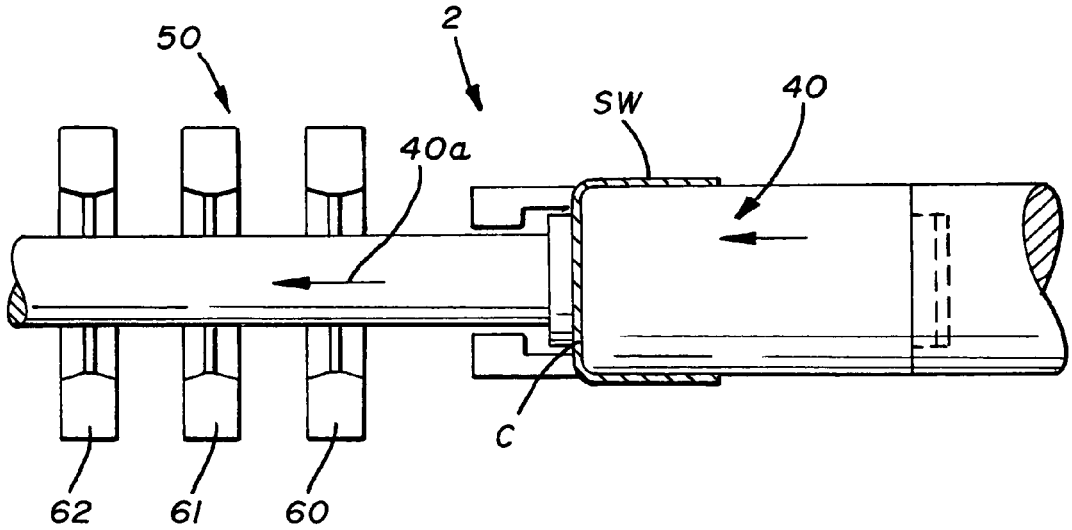
FIG. 5 is a schematic side elevational view of a ring ironing press partially sectioned to show details of a further elongation of the finished cup.
Figure 7:
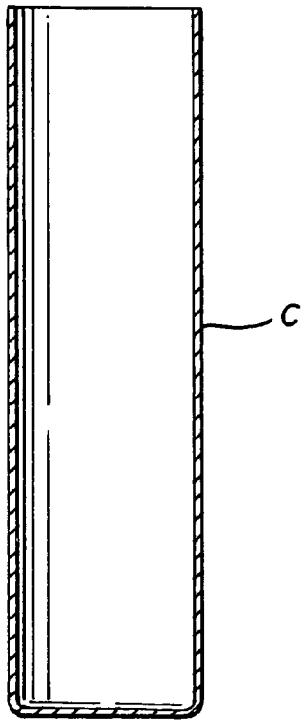
FIG. 7 is a side elevational view of a further elongated cup as it exits the ironing press.

For example, the finished cup C may be conveyed from the press 1 to an ironing press 2 that has an ironing assembly, generally indicated by the numeral 50, used to lengthen the finished cup C (FIG. 7). As best shown in FIG. 5, the finished cup C is placed on a punch 40 at the ironing assembly 50. The punch 40 is used to advance the finished cup toward fixed ironing rings 60, 61 and 62 which present progressively smaller internal diameters so as to iron the side walls SW of the cup C and elongate the cup C to its final desired dimension. This is accomplished by further advance of the redraw punch 40 in the direction of the arrow 40*a*. Once the assembled tooling has passed through the ironing ring 60, 61, 62 it may be removed from the ironing punch 40 in a conventional fashion.

Figure 2:
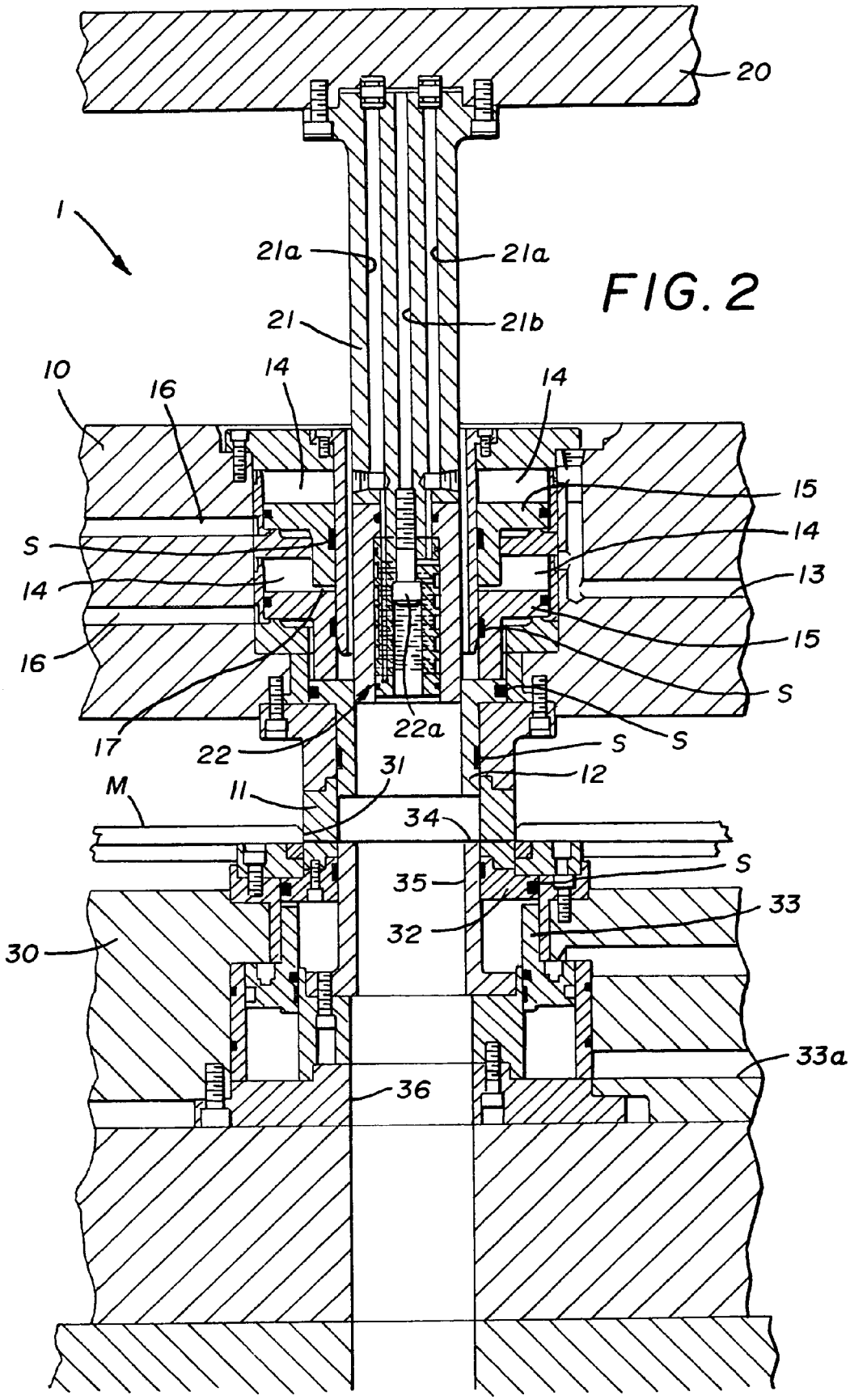
FIG. 2 is a sectional side elevational view similar to FIG. 1 with the punch fully raised and the material inserted.
Figure 3:
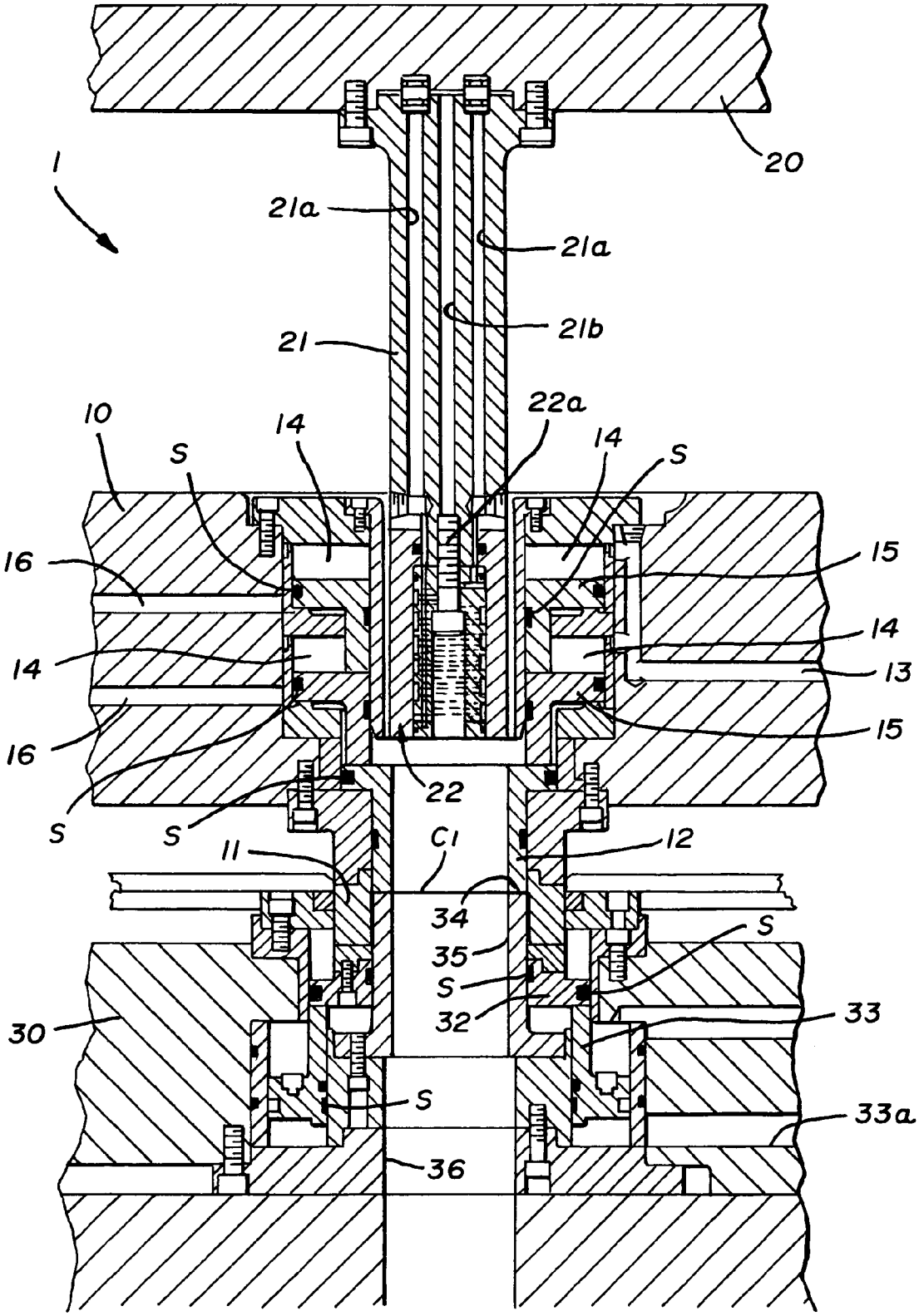
FIG. 3 is a sectional side elevational view similar to FIG. 2 depicting the descent of the outer slide to a position where the punch shell has blanked and wiped the material over the die core to form an inverted cup.
Figure 3A:
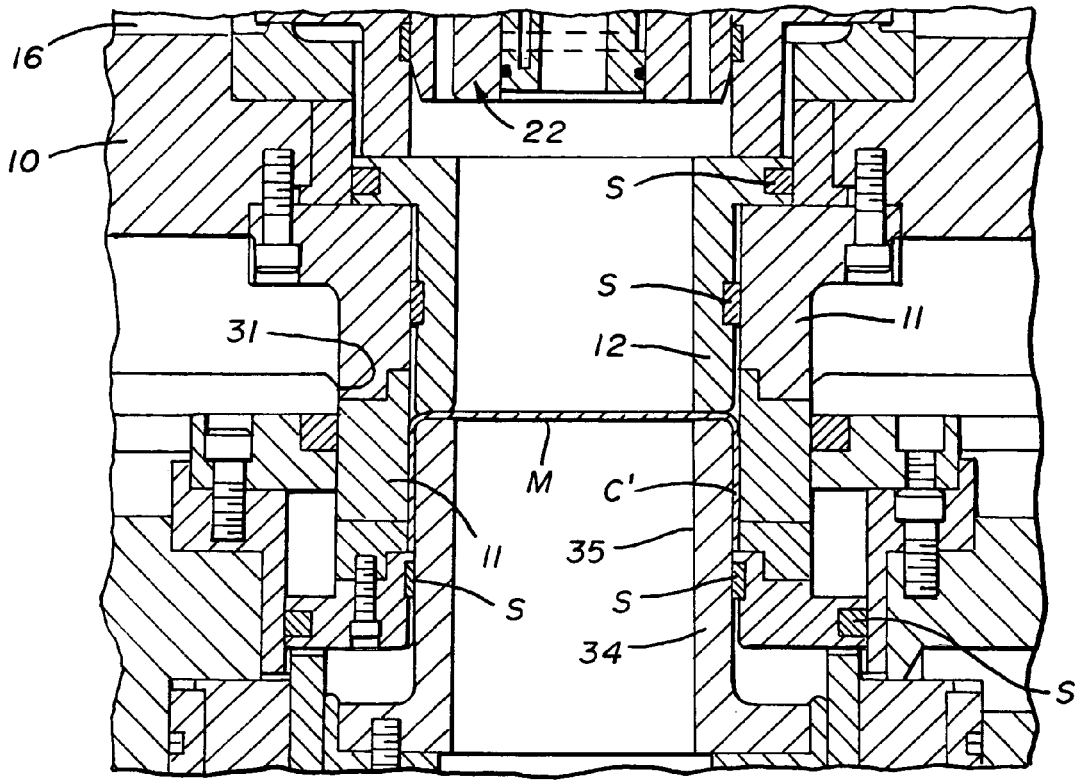
FIG. 3*a* is a sectional side elevational view similar to FIG. 3 enlarged to show details of the inverted cup formation.

Turning to the operation of the press 1, with reference to FIG. 2, the press 1 is shown in an open condition with the punch shell 11 poised above the cut edge 31. Material M is fed into the press 1 and lies over the bore defined by the die core ring 34. As can be seen in FIG. 2, the outer slide 10 descends such that the punch shell 11 blanks the material M at the cut edge 31 to begin the drawing of a first cup C' shown in FIG. 3A. At this point, the punch shell 11 clamps the material M against the pressure pad 32, which is in an elevated position. Further downward movement of the punch shell 11 overcomes the air pressure supporting the pressure pad 32 driving it downward as best shown in FIGS. 3 and 3A. The material M is drawn from the periphery of the blank downward over the top of the die core ring 34. At the same time, the pressure sleeve 12 has advanced so as to hold the material M against the top of the die core ring 34.

Figure 4:
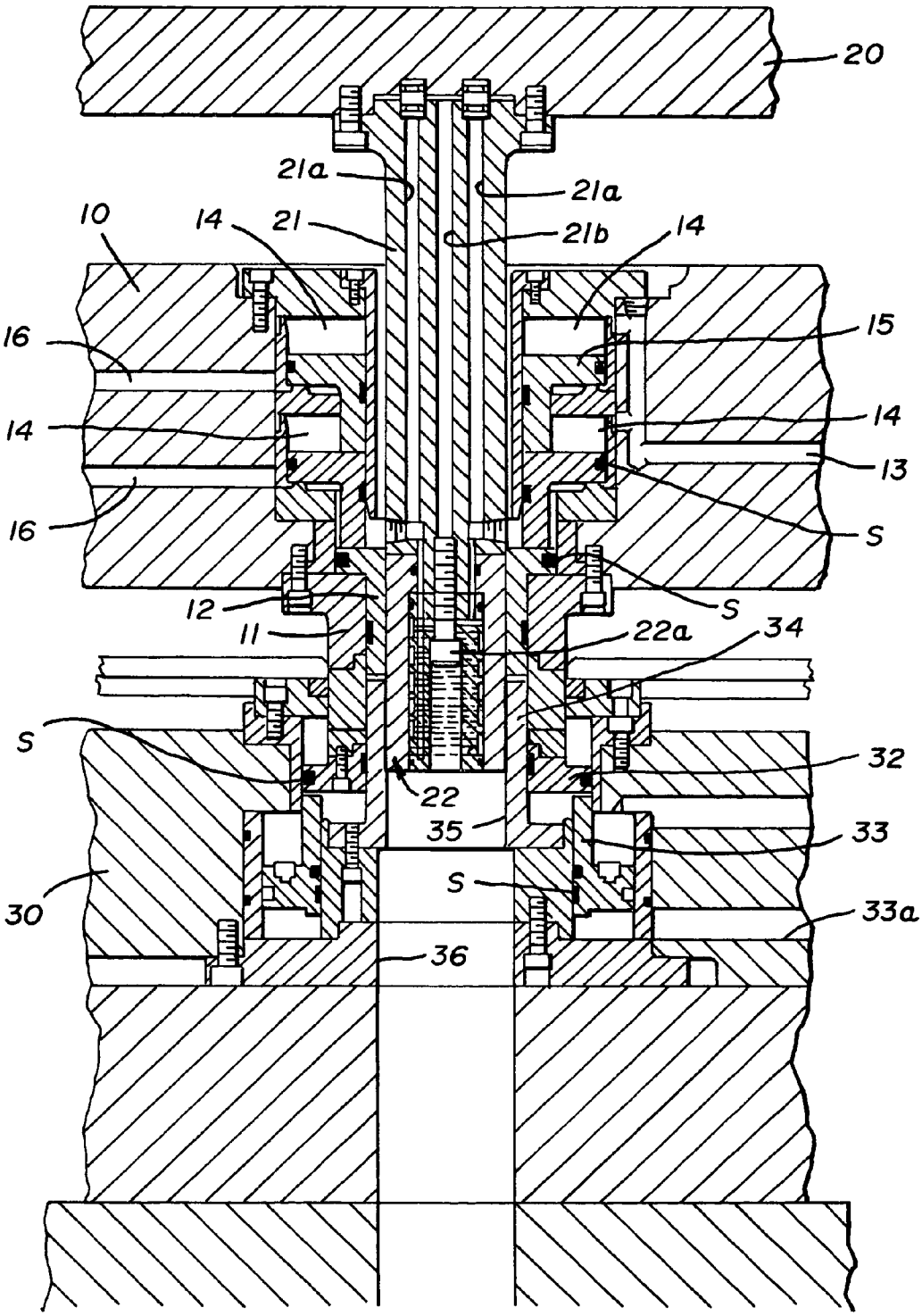
FIG. 4 is sectional side elevational view similar to FIG. 3 depicting descent of the inner slide and punch core downward to draw the inverted cup into the bore of the die core to form a finished cup.

Further advance of the punch core riser 21, as seen in FIGS. 4 and 4*a*, advances the punch core 22 against the center portion of the blank initiating a reverse draw of the previously formed first cup C'. Initially, the upper pressure sleeve 12 is still in contact with the material M such that the material M is slidingly clamped between the pressure sleeve 12 and die core ring 34. As the punch core 22 redraws the cup C' the material M slides beneath the outer pressure sleeve 12 in a controlled manner. Ultimately, the material M clears the outer pressure sleeve 12 as the finished cup C is formed. After which, a charge of air may be delivered through passage 21*b* to eject the cup C from the punch core 22 sending it through the exit bore 36.

During the process, coolant 24 is circulated through passages 21*a* and 27 to maintain a selected temperature within the punch core 22. By doing this, cups may be wiped to form a first cup C' and drawn to form a longer finished cup C in a single press 1.

Figure 6:
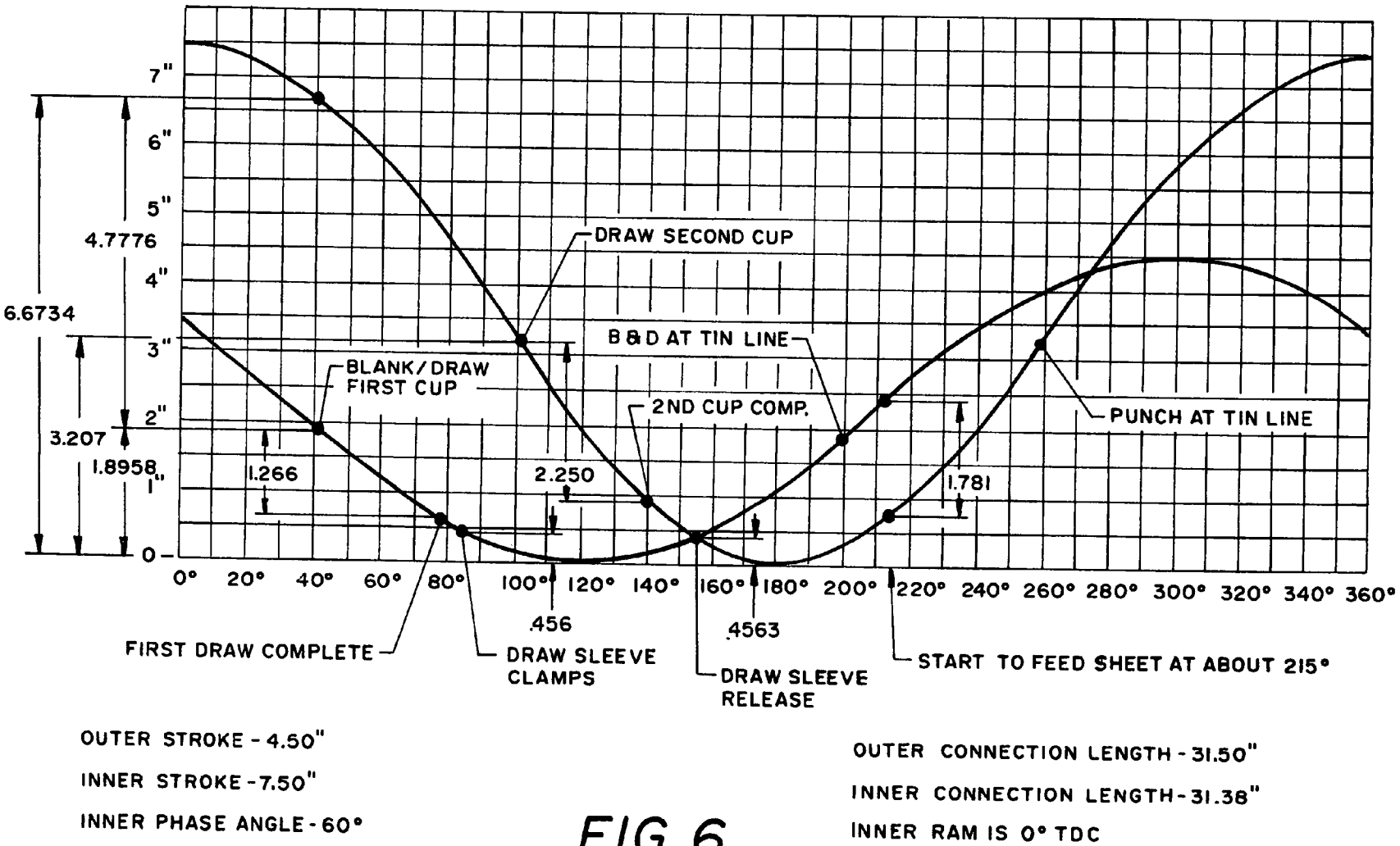
FIG. 6 is a diagram of the inner and outer slide movements as a function of the drive linkage rotational angle.

With reference to FIG. 6, the sequence described above is shown in reference to the stroke of the inner slide 20 and outer slide 10 as function of a rotation of the drive linkage or cam. In particular, the system has an outer stroke of at least 4 inches and an inner stroke of at least 7 inches. At 40° revolution of the linkage, the outer stroke is just less than 2 inches and causes blanking and drawing of an inverted first cup C'. At this point, in the example shown, the cup C' may undergo a diameter reduction in the range of about 25% to about 45%. A reduction of about 32.6% is shown in the FIGURES. The stroke continues downwardly approximately 1.26 inches to complete the first draw at nearly 80° rotation. At this point in the given example, the first cup C' has undergone a diameter reduction in the range of about 18% to about 26%. A reduction of about 25.8% is shown in the FIGURES. Continued downward movement of the outer sleeve 12 clamps the material M at die core ring 34 at about 90° and 0.5 inches. With the material M clamped by the outer sleeve 12, the inner slide 20 begins formation (redraw) of a second cup C at approximately 100° rotation with the inner slide at just over 3 inches. While the clamping force is maintained at the outer sleeve, the second cup C is completed at approximately 140°. The first redraw may provide a diameter reduction in the range of about 25% to about 30%. In the given example, at the formation of the second cup, the cup has undergone a 30% reduction. At 150°, the inner and outer strokes converge and the draw sleeve is released. Further rotation the linkage returns the inner slide 20 and outer slide 10 to the tin line and causes advancing of a new sheet of material M into the punch as shown in FIG. 6. The approximate phase angle between the outer and inner strokes is about 60°. The outer and inner connection links of the linkages are approximately equal at 31.5 and 31.38 inches respectively. These lengths are provided as an example and are not to be considered limiting.

In using the above apparatus and method of operating press 1, reduction of about at least 25% may be achieved throughout the process to create an elongated cup C useful in forming an elongated container in further processing. Such reduction rates were not possible with existing systems. The improved reduction results in a longer cup C, relative to existing systems, being produced. In effect, the elongated cup C provides a head start for further processing, which previously made drawing of such elongated containers impractical because of the extremely large draw strokes required.

While a full and complete description of the invention has been set forth in accordance with the dictates of the Patent Statutes, it should be understood that modifications can be resorted to without departing from the spirit hereof or the scope of the appended claims.

What is claimed is:

1. An apparatus for forming a cup used in forming an elongated container comprising:

(A) a draw-redraw station comprising (1) one or more slides carrying (a) a punch shell;

(b) an axially movable pressure sleeve located radially inward of said punch shell;

(c) a punch core riser, a punch core mounted on said punch core riser with said punch core located radially inward of said pressure sleeve; and (2) a fixed base carrying (a) a cut edge;

(b) a pressure pad located radially inward of said cut edge;

(c) a die core ring located radially inward of said pressure pad; and (d) a die core which is a bore located radially inward of said die core ring;

(3) said punch shell being movable toward said base to blank material inserted into said apparatus against said cut edge and being movable toward said die core ring to wipe the blank over said die core ring to form an inverted cup;

(4) said punch core being movable toward said die core to reverse draw the inverted cup and form the cup in said bore of said die core;

(5) said die core ring engaging the material against said punch core during the reverse draw to control metal thickness, wherein said cup is ejected through a bore in a bottom of said base;

(6) a coolant passage formed in said punch core riser; and (7) a chiller fluidly connected to said coolant passage, said chiller being adapted to deliver a coolant to said coolant passage, wherein said chiller is adapted to maintain said coolant at a selected temperature.

2. The apparatus of claim 1, wherein: the material undergoes a diameter reduction in the range of about 25% to about 45% in forming said inverted cup; and wherein a diameter reduction in the range of about 25% to about 30% occurs during said reverse draw.

3. The apparatus of claim 1 further comprising a plurality of circular coolant passages formed in the punch core, said colorant passages being fluidly connected to each other and said coolant passage in said punch core riser, whereby coolant circulates through said punch core.

4. A apparatus of claim 1, wherein said punch shell has a stroke of at least 4 inches and said punch core has a stroke of at least 7 inches.

5. The apparatus of claim 4, wherein a phase angle between said strokes is about 60°.

6. The apparatus of claim 4, wherein a stroke of said punch shell is 4.5 inches and the stroke of said punch core is 7.5 inches.

7. The apparatus of claim 1, wherein said coolant temperature is maintained at at least ambient temperature.

8. The apparatus of claim 7, wherein said temperature is about 120° F.

9. The apparatus of claim 1 wherein said punch core includes an inner core fastened to said punch core riser, said inner core defining a coolant passage extending in a crosswise fashion throughout said inner core; said passage in said inner core being in fluid communication with the coolant passage formed in said punch core riser, and a sleeve mounted on said punch core riser and surrounding said inner core.

10. The apparatus of claim 9, wherein said passages in said inner core are circular and open radially from said inner core; wherein said inner core includes a plurality of recesses spanning plural passages to provide fluid communication therebetween.

11. The apparatus of claim 10, wherein said inner core defines diametrically opposed recesses that are axially offset relative to each other by the axial dimension of one of said passages, wherein said plurality of passages open into said recesses in pairs whereby coolant is carried downward as it passes through said passages and recesses.

12. The apparatus of claim 9, wherein said passage in said inner core include an inlet connecting said passage to said coolant passage in said punch core riser wherein said inlet has a reduced cross-section relative to said coolant passage in said punch core riser.

13. The apparatus of claim 1, wherein said one or more slides defines a plurality of annular chambers in which a plurality of pistons are received, wherein said pistons are stacked axially and operably interconnect with said pressure sleeve wherein air is supplied to said punch core compresses air within said chambers behind said pistons; and wherein a gap is provided between said pistons, whereby said gap causes a delay between the contacting of each of said pistons.

14. A method of forming a cup for forming an elongated container comprising:

(a) blanking a sheet of material to form a blank;

(b) wiping the peripheral edge of the blank about a die core ring to form an inverted cup;

(c) reverse drawing the inverted cup to from a cup in a die core by advancing a punch into said die core which is a bore located radially inward of said die core ring;

(d) ejecting said cup through a bore in a bottom of a base; and (e) removing heat from said punch by circulating a coolant through passages formed in said punch.

15. The method of claim 9 further comprising dissipating heat around said die core by venting hot air surrounding said die core through enlarged air passage ways extending outward from said die core.

16. The method of claim 14, wherein said step of circulating a coolant includes channeling said coolant annularly throughout an inner core of said punch.

* * * * *

UNITED STATES PATENT AND TRADEMARK OFFICE

CERTIFICATE OF CORRECTION

PATENT NO. : 7,000,445 B2
APPLICATION NO. : 10/737587
DATED : February 21, 2006
INVENTOR(S) : Mark E. Hepner et al.

It is certified that error appears in the above-identified patent and that said Letters Patent is hereby corrected as shown below:

Column 2, line 48, “die core to form” should be --die core ring to form--.
Column 7, line 12, “colorant” should be --coolant--.
Column 7, line 15, “A” should be --The--.
Column 8, lines 14 through 15, “supplied to said punch core compresses air within said chambers” should be --supplied to said chambers--.
Column 8, line 25, “from” should be --form--.

Signed and Sealed this

Twenty-seventh Day of January, 2009

JOHN DOLL
*Acting Director of the United States Patent and Trademark Office*